US009358794B2

(12) United States Patent
Matsumoto et al.

(10) Patent No.: US 9,358,794 B2
(45) **Date of Patent: *Jun. 7, 2016**

(54) LIQUID EJECTING APPARATUS

(71) Applicant: SEIKO EPSON CORPORATION, Tokyo (JP)

(72) Inventors: Hitoshi Matsumoto, Matsumoto (JP); Hitotoshi Kimura, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/728,598

(22) Filed: Jun. 2, 2015

(65) Prior Publication Data

US 2015/0258799 A1 Sep. 17, 2015

Related U.S. Application Data

(63) Continuation of application No. 14/589,409, filed on Jan. 5, 2015, now Pat. No. 9,073,336.

(30) Foreign Application Priority Data

Jan. 7, 2014 (JP) ..... 2014-000786

(51) Int. Cl.
*B41J 2/175* (2006.01)
*B41J 2/18* (2006.01)

(52) U.S. Cl.
CPC ..... *B41J 2/175* (2013.01); *B41J 2/17596* (2013.01); *B41J 2/18* (2013.01)

(58) Field of Classification Search
CPC .... B41J 2/175; B41J 2/17503; B41J 2/17556; B41J 2/17596; B41J 2202/21; B41J 2/18
USPC ..... 347/29, 32, 84–86, 89, 92, 93
See application file for complete search history.

(56) References Cited

U.S. PATENT DOCUMENTS

| | | | | |
|---|---|---|---|---|
| 6,517,189 | B2 * | 2/2003 | Ogawa | B41J 2/16532 347/29 |
| 7,380,927 | B2 | 6/2008 | Shigemura | |
| 7,963,632 | B2 * | 6/2011 | Umeda | B41J 2/16511 347/29 |
| 8,141,993 | B2 | 3/2012 | Kumagai et al. | |
| 8,337,002 | B2 * | 12/2012 | Akiyama | B41J 2/175 347/85 |
| 9,073,336 | B1 * | 7/2015 | Matsumoto | B41J 2/17596 |
| 2006/0139419 | A1 | 6/2006 | Shigemura | |
| 2011/0199424 | A1 | 8/2011 | Yokouchi et al. | |
| 2013/0010037 | A1 | 1/2013 | Yokoyama et al. | |

FOREIGN PATENT DOCUMENTS

| | | |
|---|---|---|
| JP | 2006-168023 | 6/2006 |
| JP | 2006-181949 | 7/2006 |
| JP | 2011-042117 | 3/2011 |
| JP | 2011-110853 | 6/2011 |
| JP | 2011-183795 | 9/2011 |
| JP | 2012-030496 | 2/2012 |
| JP | 2013-063628 | 4/2013 |
| JP | 2013-180411 | 9/2013 |

* cited by examiner

*Primary Examiner* — An Do
(74) *Attorney, Agent, or Firm* — Workman Nydegger

(57) ABSTRACT

A liquid ejecting apparatus includes a liquid flow path connecting a liquid containing unit that contains a liquid to a liquid ejecting unit that ejects the liquid. The liquid flow path includes a supply flow path which connects the liquid containing unit to the liquid ejecting unit and a return flow path which connects the liquid ejecting unit to the liquid containing unit. When the liquid is not ejected by the liquid ejecting unit, the liquid contained in the liquid containing unit is circulated between the liquid containing unit and the liquid flow path by allowing the liquid to flow in order of the supply flow path, the liquid ejecting unit, and the return flow path. When the liquid is ejected, the liquid contained in the liquid containing unit is supplied to the common liquid chamber via both of the supply flow path and the return flow path.

12 Claims, 4 Drawing Sheets

LIQUID EJECTING APPARATUS

CROSS-REFERENCE TO RELATED APPLICATIONS

The present application is a Continuation of U.S. patent application Ser. No. 14/589,409 filed on Jan. 5, 2015, now U.S. Pat. No. 9,073,336, which claims priority to Japanese Patent Application No. 2014-000786, filed on Jan. 7, 2014, which applications are both incorporated by reference herein.

BACKGROUND

1. Technical Field

The present invention relates to a liquid ejecting apparatus such as a printer.

2. Related Art

In the related art, as examples of liquid ejecting apparatuses, there are ink jet printers that perform printing by ejecting ink supplied from sub-tanks via ink inflow paths from ink jet heads to sheets. Of the ink jet printers, there are ink jet printers that suppress ejection failures by returning ink from ink jet heads to sub-tanks via discharge flow paths and collecting bubbles or the like in the ink inflow paths and the discharge flow paths to the sub-tanks (for example, see JP-A-2012-30496).

However, when printing is performed in the above-described printers, ink is supplied from the ink inflow paths to the ink jet heads by closing circulation valves installed between the discharge flow paths and the sub-tanks and interrupting flow of the ink from the ink inflow paths to the discharge flow paths. However, when an amount of ink ejected from the ink jet head per unit time increases, a problem may occur in that an amount of liquid supplied from a sub-tank may be short.

SUMMARY

An advantage of some aspects of the invention is to provide a liquid ejecting apparatus capable of suppressing an ejection failure. Further, an advantage of some aspects of the invention is to provide a liquid ejecting apparatus capable of supplying a liquid to a liquid ejecting unit while suppressing an ejection failure. Furthermore, an advantage of some aspects of the invention is to provide a liquid ejecting apparatus capable of increasing an amount of liquid supplied to a liquid ejecting unit.

Hereinafter, means of the invention and operation effects thereof will be described.

According to an aspect of the invention, there is provided a liquid ejecting apparatus including: a liquid containing unit that contains a liquid; a liquid ejecting unit that ejects the liquid; a liquid flow path that connects the liquid containing unit to the liquid ejecting unit; a flowing mechanism that flows the liquid in the liquid flow path; and a regulation portion that is able to regulate flow of the liquid in the liquid flow path. The liquid ejecting unit includes a plurality of nozzles, a common liquid chamber which stores the liquid supplied from the liquid flow path, and a plurality of pressure chambers which communicate with the common liquid chamber and the nozzles. The liquid flow path includes a liquid storage chamber which includes an inlet and an outlet and communicates with the common liquid chamber, a supply flow path which connects the liquid containing unit to the inlet, and a return flow path which connects the outlet to the liquid containing unit and in which the regulation portion is installed. When the liquid is not ejected from the nozzles and the regulation portion does not regulate flow of the return flow path, the liquid is circulated between the liquid containing unit and the liquid flow path by allowing the liquid contained in the liquid containing unit to flow in order of the supply flow path, the liquid storage chamber, and the return flow path by driving of the flowing mechanism. When the liquid is ejected from the nozzles and the regulation portion does not regulate the flow of the return flow path, the liquid is supplied from the liquid storage chamber to the common liquid chamber by allowing the liquid contained in the liquid containing unit to flow to the liquid storage chamber via both of the supply flow path and the return flow path.

In this configuration, when no liquid is ejected from the nozzles, foreign matters such as bubbles in the liquid flow path is collected in the liquid containing unit by circulating the liquid between the liquid containing unit and the liquid flow path. Thus, it is possible to prevent the foreign matters from flowing to the liquid ejecting unit. Further, when the liquid is ejected from the nozzles, it is possible to increase an amount of liquid supplied to the liquid ejecting unit by allowing the liquid to flow to the liquid storage chamber via the supply flow path and the return flow path compared to the case in which the liquid is supplied to the liquid storage chamber via only the liquid flow path.

In the liquid ejecting apparatus, a filter may be installed between the liquid storage chamber and the common liquid chamber.

In this configuration, flow path resistance of a flow path connected to the common liquid chamber is increased by the filter. Therefore, when the liquid is circulated between the liquid containing unit and the liquid flow path, it is possible to prevent flow of the liquid oriented from the liquid storage chamber to the common liquid chamber. Further, when the liquid is ejected from the nozzles, the foreign matters such as bubbles can be prevented from flowing to the liquid ejecting unit by allowing the filter to filter the liquid flowing from the liquid storage chamber to the common liquid chamber.

In the liquid ejecting apparatus, a flexible portion capable of changing a capacity of the liquid flow path by being bent and displaced may be installed in the liquid flow path.

In this configuration, when pressure in the liquid flow path is changed by driving of the flowing mechanism or an operation of the regulation portion, the flexible portion is bent and displayed, and thus an unnecessary change in the pressure can be prevented in the liquid ejecting unit connected to the liquid flow path.

In the liquid ejecting apparatus, a one-way valve permitting flow of the liquid from the liquid containing unit to the liquid storage chamber and regulating the flow of the liquid from the liquid storage chamber to the liquid containing unit may be installed in the supply flow path.

When meniscuses formed in the nozzles are broken due to a change in pressure in the liquid ejecting unit or the like, air flows from the nozzles in place of outflow of the liquid from the nozzles in some cases. In this configuration, since the flow oriented from the liquid storage chamber to the liquid containing unit is regulated by the one-way valve, air flowing from the nozzles can be prevented from turning to bubbles and flowing backward to the liquid storage chamber.

In the liquid ejecting apparatus, the liquid storage chamber may include a plurality of the outlets. The return flow path may include a main flow path communicating with the liquid containing unit and a plurality of branch flow paths branched from the main flow path and communicating with the outlets. The regulation portion may be installed in the main flow path.

In this configuration, by forming the plurality of branch flow paths on the side of the liquid storage chamber of the return flow path, a loss of pressure at the time of the flow of the liquid from the liquid containing unit to the liquid storage chamber can be allowed to be less than a loss of pressure at the time of the flow of the liquid from the liquid storage chamber to the liquid containing unit. Thus, since the liquid easily flows from the liquid containing unit to the liquid storage chamber, an amount of liquid supplied to the liquid ejecting unit can be increased when the liquid is ejected from the nozzles. When the liquid is circulated between the liquid containing unit and the liquid flow path, it is possible to flow the foreign matters in the liquid storage chamber from the plurality of outlets to the liquid containing unit. Thus, it is possible to increase a collection rate of the foreign matters collected in the liquid containing unit. When the regulation portion is installed in the branch flow path, it is necessary to separately install the regulation portions in the plurality of branch flow paths. However, when the regulation portion is installed in the main flow path, it is not necessary to install the plurality of regulation portions as in the case in which the regulation portions are separately installed in the plurality of branch flow paths. The configuration can be simplified.

In the liquid ejecting apparatus, in the liquid storage chamber, the plurality of outlets may be disposed at positions closer to end portions of the liquid storage chamber in a longitudinal direction of the liquid storage chamber than the inlet, and the inlet may be disposed between the outlets in the longitudinal direction.

For example, when the liquid storage chamber is formed in a long and narrow flow path shape extending in the longitudinal direction and the inlet and the outlets are disposed at positions distant from end portions in the longitudinal direction, flow is rarely formed at end portions of the liquid storage chamber in the longitudinal direction when the liquid is circulated. Therefore, the foreign matters easily remain in the liquid storage chamber. Thus, In this configuration, since the plurality of outlets are disposed at positions closer to the end portions in the longitudinal direction of the liquid storage chamber than the inlet, the foreign matters remaining in the end portions in the longitudinal direction of the liquid storage chamber easily flow out from the outlets to the return flow path.

When the distances between the inlet and the outlets are great, flow oriented from the inlet to the outlets is rarely formed at the time of the circulation of the liquid. Thus, In this configuration, since the inlet is disposed between the two outlets in the longitudinal direction, the distances between the inlet and the outlets can be shortened compared to the case in which one inlet and one outlet are disposed on each of both end sides in the longitudinal direction of the liquid storage chamber. Thus, it is possible to flow the liquid in the liquid storage chamber.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, embodiments of a liquid ejecting apparatus will be described with reference to the drawings.

The liquid ejecting apparatus is, for example, an ink jet printer that performs printing by ejecting ink which is an example of a liquid to a medium such as a sheet.

First Embodiment

Figure 1:
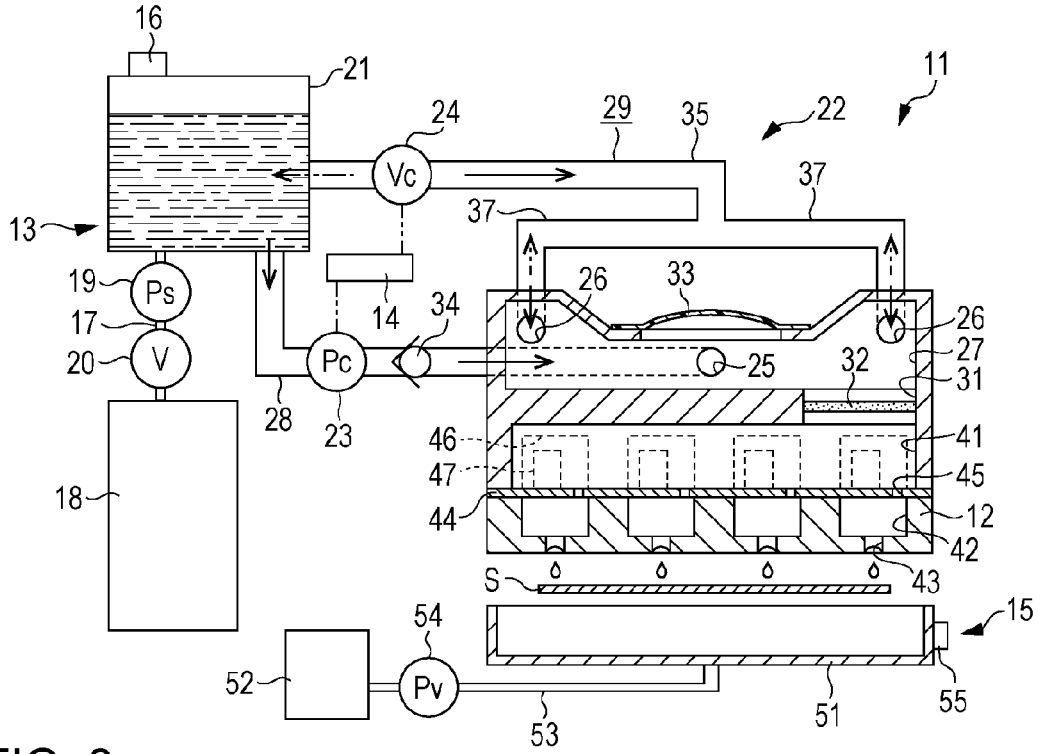
FIG. 1 is a schematic diagram illustrating the configuration of a liquid ejecting apparatus according to a first embodiment.

As illustrated in FIG. 1, a liquid ejecting apparatus 11 according to an embodiment includes a liquid ejecting unit 12 that ejects a liquid, a liquid supply mechanism 13 that supplies the liquid to the liquid ejecting unit 12, a control unit 14 that controls the liquid supply mechanism 13, and a maintenance mechanism 15 that performs maintenance of the liquid ejecting unit 12.

The liquid supply mechanism 13 includes a liquid containing unit 21 that contains a liquid, a liquid flow path 22 that connects the liquid containing unit 21 to the liquid ejecting unit 12, a flowing mechanism 23 that flows the liquid in the liquid flow path 22, and a regulation portion 24 that can regulate flow of the liquid of the liquid flow path 22.

An atmospheric communication valve 16 is installed in the liquid containing unit 21. When the atmospheric communication valve 16 enters a valve-opened state, the liquid containing unit 21 communicates with the atmosphere. The liquid containing unit 21 communicates with a liquid supply source 18 via an injection flow path 17. A pump 19 that flows the liquid from the liquid supply source 18 to the liquid containing unit 21 and an on-off valve 20 that opens and closes the injection flow path 17 between the pump 19 and the liquid supply source 18 are installed in the injection flow path 17. When the on-off valve 20 is in an opened state and the pump 19 is driven, the liquid is injected from the liquid supply source 18 to the liquid containing unit 21 via the injection flow path 17.

The liquid ejecting unit 12 includes a plurality of nozzles 43 that eject liquid droplets, a common liquid chamber 41 that stores the liquid supplied from the liquid flow path 22, and a plurality of pressure chambers 42 that communicate with the common liquid chamber 41 and the nozzles 43. In the embodiment, an arrangement direction (right and left directions in FIG. 1) of the plurality of nozzles 43 to which the liquid is supplied via the common liquid chamber 41 is referred to as a nozzle line direction.

The common liquid chamber 41 and the pressure chambers 42 communicate with each other via communication holes 45. Parts of the wall surfaces of the pressure chambers 42 are formed by a vibration plate 44. Actuators 47 contained in containing chambers 46 are arranged on the opposite surface to portions of the vibration plate 44 facing the pressure chambers 42 and at different positions from the common liquid chamber 41.

The actuator 47 is a piezoelectric element that contracts, for example, when a driving voltage is applied. When the driving voltage is applied to the actuators 47, the vibration plate 44 is deformed and the capacities of the pressure chambers 42 are changed, so that the liquid in the pressure chambers 42 is ejected as liquid drops from the nozzles 43.

The maintenance mechanism 15 includes a cap 51 that can be moved relatively with respect to the liquid ejecting unit 12, a waste liquid containing unit 52, a waste liquid flow path 53 that connects the cap 51 to the waste containing unit 52, a depressurization mechanism 54 installed in the waste liquid flow path 53, and an atmospheric opening valve 55 attached to the cap 51.

Figure 2:
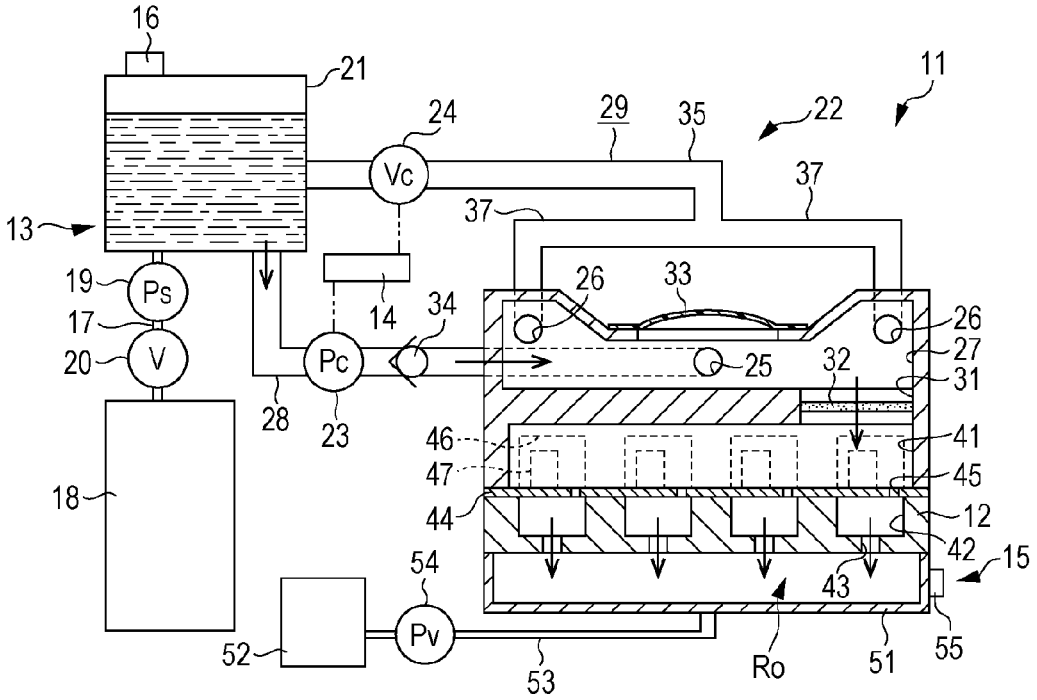
FIG. 2 is a schematic diagram when a liquid is discharged from nozzles of the liquid ejecting apparatus according to the first embodiment.

As illustrated in FIG. 2, the cap 51 is moved in a direction in which the cap 51 approaches the liquid ejecting unit 12 and encloses a space Ro in which the nozzles 43 are opened. In the embodiment, the fact that the cap 51 encloses the space Ro in which the nozzles 43 are opened is referred to as "capping." The cap 51 is not limited to a box shape with a bottom and an open portion, as illustrated in FIG. 2. For example, a circular elastic member enclosing the region in which the nozzles 43 are opened may be disposed on the side of the liquid ejecting unit 12 and a member coming into contact with the elastic member to enclose the space Ro may be referred to as the cap 51.

When the liquid ejecting unit 12 is capped and the atmospheric opening valve 55 enters a valve-opened state, the space Ro is opened to the atmosphere. On the other hand, when the atmospheric opening valve 55 enters a valve-closed state, the space Ro enters a substantially airtight state. Therefore, when the liquid ejecting unit 12 is capped, the atmospheric opening valve 55 enters the valve-closed state, and the depressurization mechanism 54 is driven, the inside of the space Ro is depressurized, a negative pressure is generated, and suction cleaning is performed to discharge the liquid through the nozzles 43. Then, the liquid discharged from the nozzles 43 to the cap 51 through the suction cleaning is contained as waste liquid in the waste liquid containing unit 52 via the waste liquid flow path 53.

The liquid flow path 22 includes a liquid storage chamber 27 which includes an inlet 25 and outlets 26 and communicates with the common liquid chamber 41, a supply flow path 28 which connects the liquid containing unit 21 to the inlet 25 and in which the flowing mechanism 23 is installed, and a return flow path 29 which connects the outlets 26 to the liquid containing unit 21 and in which the regulation portion 24 is installed. A filter chamber 31 is preferably disposed between the liquid storage chamber 27 and the common liquid chamber 41 and a filter 32 is preferably installed in the filter chamber 31.

The liquid storage chamber 27 preferably includes a flexible portion 33 that is bent and displaced to change the capacity of the liquid storage chamber 27. For example, the flexible portion 33 can be formed by welding a film member which can be bent and displaced to a flow forming member that forms a part of the wall of the liquid storage chamber 27.

The liquid storage chamber 27 preferably includes a plurality of the outlets 26 (for example, two outlets). In the liquid storage chamber 27, the plurality of outlets 26 are preferably disposed at positions closer to end portions of the liquid storage chamber 27 in a longitudinal direction (the right and left directions in FIG. 1) than the inlet 25 and the inlet 25 is preferably disposed between the two outlets 26 arranged in the same longitudinal direction. In the embodiment, the nozzle line direction is assumed to be the longitudinal direction of the liquid storage chamber 27.

In the liquid storage chamber 27, the outlets 26 may be disposed on the upper side in the perpendicular direction with respect to the inlet 25 and a ceiling surface of the liquid storage chamber 27 may be inclined so that the ceiling surface is raised from the vicinity of the middle to both end sides in the longitudinal direction. This is because it is easy for bubbles mixed in the liquid storage chamber 27 to flow in the end portions in which the outlets 26 are formed along the inclination of the ceiling surface and flow out to the return flow path 29 through the outlets 26. In FIGS. 1 and 2, the flexible portion 33 forming the ceiling surface is illustrated. However, the flexible portion 33 is preferably disposed in a wall surface (for example, a side surface or a bottom surface) which does not form the ceiling surface since bubbles are prevented from remaining.

A connection portion of the liquid storage chamber 27 to the filter chamber 31 is preferably disposed at a position closer to the outlets 26 than the inlet 25 and on the lower side in the perpendicular direction than the inlet 25 and the outlets 26. This is because foreign matters of bubbles or the like entering the liquid storage chamber 27 via the inlet 25 can be prevented from flowing in the filter chamber 31.

In the supply flow path 28, a one-way valve 34 is preferably installed between the flowing mechanism 23 and the inlet 25. The one-way valve 34 is a check valve that permits flow of the liquid oriented from the liquid containing unit 21 to the liquid storage chamber 27 to flow and conversely regulates flow of the liquid oriented from the liquid storage chamber 27 to the liquid containing unit 21.

The flowing mechanism 23 is, for example, a pump which is driven under the control of the control unit 14 and which flows the liquid from the liquid containing unit 21 to the liquid storage chamber 27 and does not conversely regulate flow of the liquid when the driving is stopped. The flowing mechanism 23 can be configured as, for example, a gear pump or a diaphragm pump. When the flowing mechanism 23 is configured as a diaphragm pump, the flowing mechanism 23 preferably includes a pump chamber of which a capacity is changed with driving, a suction valve which is installed on the side of the liquid containing unit 21 than the pump chamber, and an ejection valve which is installed on the side of the liquid storage chamber 27 than the pump chamber. In this case, the suction valve functions as a one-way valve which regulates flow of the liquid oriented from the pump chamber to the liquid containing unit 21 and the ejection valve functions as a one-way valve which regulates flow of the liquid oriented from the liquid storage chamber 27 to the pump chamber. Therefore, the one-way valve 34 may not be installed in the supply flow path 28.

The return flow path 29 includes a main flow path 35 which communicates with the liquid containing unit 21 and a plurality of branch flow paths 37 (for example, two branch flow paths) which are branched from the main flow path 35 and communicate with the outlets 26. The regulation portion 24 is installed in the main flow path 35. The regulation portion 24 is an on-off valve that switches between a valve-closed state in which the flow of the main flow path 35 is regulated and a valve-opened state in which the flow of the main flow path 35 is permitted, for example, under the control of the control unit 14. A flow direction (a direction indicated by an arrow of a solid line in FIG. 1) oriented from the liquid containing unit 21 to the liquid storage chamber 27 in the return flow path 29 is referred to as a supply direction. A flow direction (a direction indicated by an arrow of a two-dot chain line in FIG. 1)

oriented from the liquid storage chamber 27 to the liquid containing unit 21 is referred to a return direction.

Next, an operation of the liquid ejecting apparatus 11 according to the embodiment will be described.

The control unit 14 controls the flowing mechanism 23 and the regulation portion 24 according to a circumstance such that a circulation mode in which the liquid is circulated between the liquid containing unit 21 and the liquid flow path 22, a supply mode in which the liquid is supplied from the liquid storage chamber 27 to the common liquid chamber 41, and a discharge mode in which the liquid is discharged from the nozzles 43 are set. For example, the control unit 14 sets the supply mode when printing is performed on a medium S by ejecting the liquid from the nozzles 43, and sets the circulation mode or the discharge mode when the liquid is not ejected from the nozzles 43, i.e., when no printing is performed.

The circulation mode is set when bubbles mixed in the liquid flow path 22 or foreign matters in the thickened liquid are collected in the liquid containing unit 21. The discharge mode is set when the foreign matters collected in the liquid containing unit 21 in the circulation mode are discharged from the nozzles 43.

In the circulation mode, when the regulation portion 24 does not regulate the flow of the return flow path 29, the liquid contained in the liquid containing unit 21 is circulated in the order of the supply flow path 28, the liquid storage chamber 27, and the return flow path 29 by driving the flowing mechanism 23. That is, in the circulation mode, the liquid flows through the supply flow path 28, as indicated by an arrow of a solid line in FIG. 1 and enters the liquid storage chamber 27 from the inlet 25. The liquid flowing out from the liquid storage chamber 27 to the branch flow paths 37 of the return flow path 29 through the plurality of outlets 26 flows in the return direction indicated by the arrow of the two-dot chain line in FIG. 1, joins to the main flow path 35, and returns to the liquid containing unit 21. In the flow of the liquid circulated through the liquid containing unit 21, the supply flow path 28, the liquid storage chamber 27, and the return flow path 29, foreign matters such as bubbles mixed in the liquid flow path 22 are collected in the liquid containing unit 21.

The supply flow path 28 is preferably connected to a bottom portion of the liquid containing unit 21 so that the bubbles collected in the liquid containing unit 21 do not flow out the supply flow path 28. On the other hand, the return flow path 29 is preferably connected to the liquid containing unit 21 on the upper side in the perpendicular direction with respect to the connection portion of the supply flow path 28 to the liquid containing unit 21. This is because it is difficult for the bubbles entering the inside of the liquid containing unit 21 via the return flow path 29 to enter the supply flow path 28.

In the supply mode, when the driving of the flowing mechanism 23 is stopped and the regulation portion 24 does not regulate the flow of the return flow path 29, the liquid contained in the liquid containing unit 21 is allowed to flow to the liquid storage chamber 27 via both of the supply flow path 28 and the return flow path 29, to supply the liquid from the liquid storage chamber 27 to the common liquid chamber 41.

When the liquid is ejected from the nozzles 43 by driving the actuators 47 at the time of printing in which the supply mode is set, the liquid of the liquid storage chamber 27 corresponding to an amount of liquid flowing out from the pressure chambers 42 through the ejecting is supplied to the pressure chambers 42 via the filter chamber 31 and the common liquid chamber 41. The liquid of the liquid containing unit 21 corresponding to the amount of liquid flowing out from the liquid storage chamber 27 to the pressure chambers 42 is supplied to the liquid storage chamber 27 via the supply flow path 28 and the return flow path 29.

Thus, when the regulation portion 24 does not regulate the flow of the return flow path 29, the liquid flows in the return flow path 29 in the supply direction indicated by the arrow of the solid line in FIG. 1 and the liquid flows in the supply flow path 28 in the direction indicated by the arrow of the solid line in FIG. 1, so that the liquid is supplied to the liquid storage chamber 27, in spite of the fact that the flowing mechanism 23 is not driven. That is, when the liquid is ejected from the nozzles 43, the liquid is supplied from the liquid containing unit 21 to the liquid storage chamber 27 via both of the supply flow path 28 and the return flow path 29.

In the discharge mode, by driving the flowing mechanism 23 when the regulation portion 24 regulates the flow of the return flow path 29, as illustrated in FIG. 2, the liquid in the liquid containing unit 21 is allowed to flow in the order of the supply flow path 28, the liquid storage chamber 27, the filter chamber 31, the common liquid chamber 41, and the pressure chambers 42 to be discharged from the nozzles 43. Thus, the foreign matters such as bubbles collected in the liquid containing unit 21 are discharged together with the liquid from the nozzles 43.

At this time, since the flow of the liquid is regulated in the return flow path 29 by the regulation portion 24, the liquid flowing to the liquid storage chamber 27 via the supply flow path 28 does not flow to the return flow path 29, but flows toward the side of the liquid ejecting unit 12. Further, when solid matters solidified from a solute component of ink are present as foreign matters mixed in the liquid, the inflow to the common liquid chamber 41 is regulated by the filter 32. Thus, the nozzles 43 are prevented from being clogged due to the solid matters. The liquid having the foreign matters discharged from the nozzles 43 to the cap 51 is contained as a waste liquid in the waste liquid containing unit 52 by driving the depressurization mechanism 54.

In order to flow the bubbles together with the liquid, it is necessary to set a flow rate of the liquid to be a given value or more. Therefore, when the maintenance mechanism 15 performs suction cleaning, the discharge mode is set. By driving both of the depressurization mechanism 54 and the flowing mechanism 23, the liquid may be discharged from the nozzles 43. This is because the bubbles can efficiently be discharged since the flow rate of the liquid flowing inside the liquid ejecting unit 12 can be configured to be faster than when the liquid is allowed to flow only by a driving force of the flowing mechanism 23. Alternatively, the depressurization mechanism 54 may be sufficiently driven to collect the liquid discharged from the nozzles 43 in the waste liquid containing unit 52 by the driving force of the flowing mechanism 23.

The discharging of the liquid performed by setting the discharge mode can be performed at a predetermined timing at which foreign matters such as bubbles gather in the liquid containing unit 21. When the liquid is consumed through ejection of the liquid in the supply mode or the liquid is discharged from the liquid containing unit 21 in the discharge mode, the liquid is supplied from the liquid supply source 18 to the liquid containing unit 21 by driving the pump 19.

Next, effects of the liquid ejecting apparatus 11 according to the embodiment will be described.

In the supply mode, since the liquid is supplied to the liquid storage chamber 27 via both of the of the supply flow path 28 and the return flow path 29, an amount of liquid supplied to the liquid ejecting unit 12 increases compared to the case in which the liquid is supplied to the liquid storage chamber 27 via only the supply flow path 28. Therefore, even when an amount of liquid ejected per unit time from the liquid ejecting unit 12 increases, supply shortage of the liquid rarely occurs. In particular, in the return flow path 29, a portion on the downstream side becomes the branch flow path 37 in the supply mode. Therefore, a loss of the pressure on the downstream side is small and the liquid easily flows toward the liquid storage chamber 27.

In particular, when the liquid ejecting unit 12 is a line head with a long shape corresponding to the entire width of the medium S, the number of nozzles 43 arranged in the nozzle line direction is large. Therefore, an amount of liquid ejected per unit time tends to increase. Therefore, by supplying the liquid via both of the supply flow path 28 and the return flow path 29, it is possible to prevent print quality from deteriorating due to the supply shortage of the liquid.

When the amount of liquid ejected per unit time from the liquid ejecting unit 12 is small, the liquid may be supplied from the liquid containing unit 21 to the liquid storage chamber 27 via the supply flow path 28 by allowing the regulation portion 24 to regulate the flow of the liquid in the return flow path 29 even in the case in which the liquid is ejected from the nozzles 43 at the time of printing.

In the circulation mode, foreign matters such as bubbles mixed in the liquid flow path 22 is collected in the liquid containing unit 21 through the circulation of the liquid. The liquid containing unit 21 communicates with the atmosphere via the atmospheric communication valve 16. Therefore, when bubbles enter the liquid storage chamber 27, the bubbles are expected to come out to a liquid level and disappear. In this way, when the collected bubbles disappear, the liquid may not be discharged from the nozzles 43 to discharge the bubbles out of the flow path in the discharge mode. Therefore, it is possible to reduce an amount of liquid consumed with maintenance.

Foreign matters such as bubbles flowing in the liquid storage chamber 27 remain in corners or the like of the liquid storage chamber 27, and this it is difficult to discharge the foreign matters from the return flow path 29 in some cases. In particular, when the liquid storage chamber 27 is formed in a long and narrow flow path shape extending in the longitudinal direction and the inlet 25 and the outlets 26 are disposed at positions distant from an end portion in the longitudinal direction, flow is rarely formed at an end portion of the liquid storage chamber 27 in the longitudinal direction. Therefore, the foreign matters easily remain in the liquid storage chamber 27.

Thus, when the plurality of outlets 26 are disposed at positions closer to the end portions of the liquid storage chamber 27 in the longitudinal direction than the inlet 25, the foreign matters remaining in the end portions of the liquid storage chamber 27 in the longitudinal direction easily flow out from the outlets 26.

When the distances between the inlet 25 and the outlets 26 are long, flow oriented from the inlet 25 to the outlets 26 is rarely formed in the circulation mode and foreign matters easily remain inside the liquid storage chamber 27. Thus, when the inlet 25 is disposed between the two outlets 26 arranged in the longitudinal direction of the liquid storage chamber 27, the distances between the inlet 25 and the outlets 26 can be shortened. Thus, it is possible to allow the foreign matters flowing in the liquid storage chamber 27 to flow from the inlet 25 toward the outlets 26.

When the liquid ejected by the liquid ejecting unit 12 is a solution (for example, pigment ink having a pigment component as a solute) having a solute with specific gravity heavier than a solvent, a solute component can be diffused in the solvent by circulating the liquid in the liquid containing unit 21 and the liquid flow path 22 before ejection of the liquid from the nozzles 43 to the medium S. Thus, it is possible to prevent a print density from being changed due to precipitation of the solute.

When the flowing mechanism 23 is driven to allow the liquid to flow or flow is regulated by the regulation portion 24, the pressure inside the liquid storage chamber 27 may temporarily increase, for example. Thus, a change in the pressure in the liquid flow path 22 occurs in some cases. When such a change in the pressure reaches the liquid ejecting unit 12, meniscuses formed in the nozzles 43 may be broken and the liquid may leak from the nozzles 43. Therefore, in the circulation mode, the flowing mechanism 23 is preferably driven so that no liquid leaks from the nozzles 43. For example, the flowing mechanism 23 is preferably driven so that the pressure acting on the meniscuses formed in the nozzles 43 by the flow of the liquid is less than the withstand pressure of the meniscuses.

When the one-way valve 34 is installed in the supply flow path 28, air mixed in and turned to bubbles rarely flows backward to the liquid containing unit 21 in spite of the fact that the meniscuses are broken and air is mixed in, in place of the leakage of the liquid from the nozzles 43.

When the filter 32 is disposed between the liquid storage chamber 27 and the common liquid chamber 41, the liquid rarely flows from the liquid storage chamber 27 to the common liquid chamber 41 due to an increase in flow path resistance by the filter 32. Thus, a change in the pressure inside the liquid storage chamber 27 rarely reaches the liquid ejecting unit 12.

In the circulation mode and the discharge mode, the cap 51 of the maintenance mechanism 15 is preferably disposed at a position (containing position) facing the nozzles 43 of the liquid ejecting unit 12 or a capping position at which the liquid ejecting unit 12 is capped. Thus, since the liquid leaking from the nozzles 43 or the liquid discharged from the nozzles 43 can be contained in the cap 51, the liquid coming from the nozzles 43 does not dirty a surrounding area.

According to the first embodiment, the following advantages can be obtained.

(1) When no liquid is ejected from the nozzles 43, foreign matters such as bubbles in the liquid flow path 22 are collected in the liquid containing unit 21 by circulating the liquid between the liquid containing unit 21 and the liquid flow path 22. Thus, it is possible to prevent the foreign matters from flowing in the liquid ejecting unit 12. When the liquid is ejected from the nozzles 43, it is possible to increase the amount of liquid supplied to the liquid ejecting unit 12 by circulating the liquid to the liquid storage chamber 27 via the supply flow path 28 and the return flow path 29 compared to the case in which the liquid is supplied to the liquid storage chamber 27 via only the liquid flow path 22.

(2) The flow path resistance of the flow path connected to the common liquid chamber 41 is increased by the filter 32. Therefore, when the liquid is circulated between the liquid containing unit 21 and the liquid flow path 22, it is possible to prevent the liquid from flowing from the liquid storage chamber 27 to the common liquid chamber 41. When the liquid is ejected from the nozzles 43, it is possible to prevent foreign matters such as bubbles from flowing in the liquid ejecting unit 12 by allowing the filter 32 to filter the liquid flowing from the liquid storage chamber 27 to the common liquid chamber 41.

(3) When the pressure inside the liquid flow path 22 is changed by the driving of the flowing mechanism 23 or the operation of the regulation portion 24, the flexible portion 33 is bent and displaced, so that the unnecessary change in the pressure can be prevented in the liquid ejecting unit 12 connected to the liquid flow path 22. When the liquid ejecting unit 12 ejects the liquid from the plurality of nozzles 43 and the pressure of the common liquid chamber 41 is accordingly changed, the flexible portion 33 is bent and displaced, so that a liquid ejection operation from the nozzles 43 can be stabilized.

(4) Since the flow from the liquid storage chamber 27 to the liquid containing unit 21 is regulated by the one-way valve 34, air flowing from the nozzles 43 can be prevented from being turned to bubbles and flowing backward to the liquid storage chamber 27.

(5) By forming the plurality of branch flow paths 37 on the side of the liquid storage chamber 27 of the return flow path 29, a loss of the pressure at the time of the flow of the liquid from the liquid containing unit 21 to the liquid storage chamber 27 can be allowed to be less than a loss of the pressure at the time of the flow of the liquid from the liquid storage chamber 27 to the liquid containing unit 21. Thus, the liquid easily flows from the liquid containing unit 21 to the liquid storage chamber 27. Therefore, when the liquid is ejected from the nozzles 43, the amount of liquid supplied to the liquid ejecting unit 12 can increase.

(6) when the liquid is circulated between the liquid containing unit 21 and the liquid flow path 22, it is possible to allow the foreign matters in the liquid storage chamber 27 to flow from the plurality of outlets 26 to the liquid containing unit 21. Thus, it is possible to increase a collection rate of the foreign matters collected in the liquid containing unit 21.

(7) When the regulation portion 24 is installed in the branch flow path 37, it is necessary to provide the separate regulation portions 24 in the plurality of the branch flow paths 37. However, when the regulation portion 24 is installed in the main flow path 35, it is not necessary to provide the plurality of regulation portions 24 as in the case in which the separate regulation portions 24 are installed in the plurality of branch flow paths 37. Thu, the configuration can be simplified.

(8) Since the plurality of outlets 26 are disposed at the positions closer to the end portions of the liquid storage chamber 27 in the longitudinal direction than the inlet 25, foreign matters remaining in the end portions of the liquid storage chamber 27 in the longitudinal direction can easily flow from the outlets 26 to the return flow path 29.

(9) Since the inlet 25 is disposed between the outlets 26 in the longitudinal direction, the distances between the inlet 25 and the outlets 26 can be decreased compared to the case in which one inlet 25 and one outlet 26 are disposed on each of both ends of the liquid storage chamber 27 in the longitudinal direction. Thus, it is possible to flow the liquid in the liquid storage chamber 27.

Second Embodiment

Next, a second embodiment of the liquid ejecting apparatus will be described with reference to FIGS. 3 and 4. In the second embodiment, since constituent elements to which the same reference numerals as those of the first embodiment are given have the same configurations as those of the first embodiment, the description thereof will be omitted. Hereinafter, difference points from the first embodiment will be described mainly.

Figure 3:
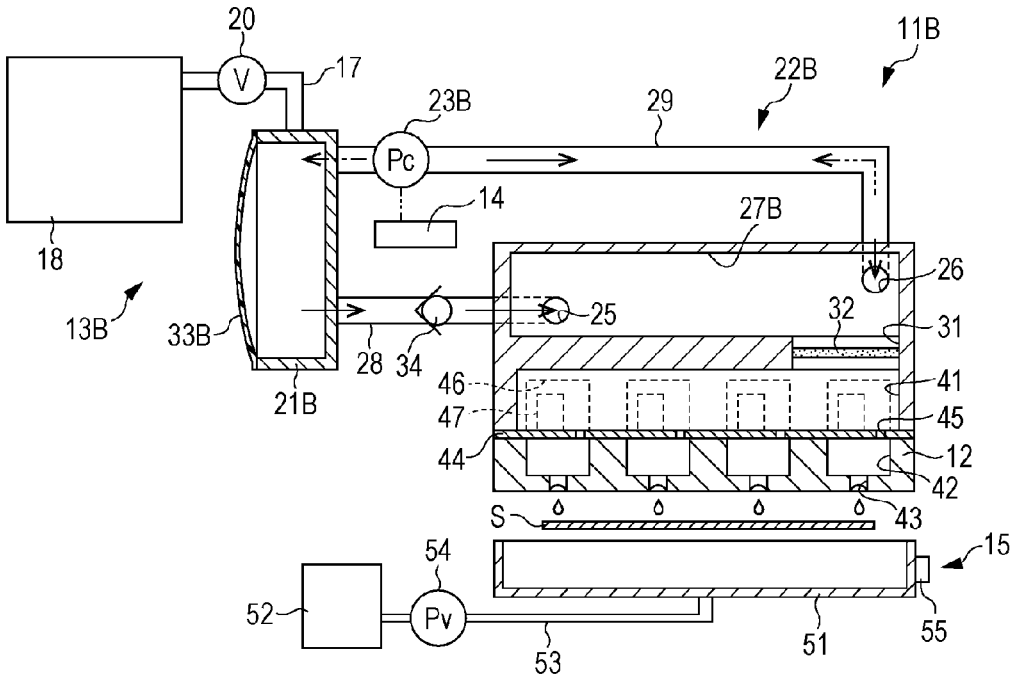
FIG. 3 is a schematic diagram illustrating the configuration of a liquid ejecting apparatus according to a second embodiment.

As illustrated in FIG. 3, a liquid supply mechanism 13B included in a liquid ejecting apparatus 11B according to the embodiment includes a liquid containing unit 21B which contains a liquid, a liquid flow path 22B which connects the liquid containing unit 21B to the liquid ejecting unit 12, and a flowing mechanism 23B in which the return flow path 29 forming the liquid flow path 22B is installed. The configurations of the liquid ejecting unit 12 and the maintenance mechanism 15 and the configuration in which the liquid of a liquid storage chamber 27C forming the liquid flow path 22B is supplied to the common liquid chamber 41 via the filter chamber 31 in which the filter 32 is installed are the same as those of the first embodiment.

The on-off valve 20 is installed in the injection flow path 17 that connects the liquid containing unit 21B to the liquid supply source 18. When the on-off valve 20 enters an opened state, the liquid is injected from the liquid supply source 18 to the liquid containing unit 21B via the injection flow path 17 by a hydraulic head difference between a liquid level in the liquid supply source 18 and a liquid level in the liquid containing unit 21B. Accordingly, when the liquid is consumed through ejection of the liquid in the supply mode or the liquid is discharged from the nozzles 43 in the discharge mode, the liquid is supplied from the liquid supply source 18 to the liquid containing unit 21B based on the hydraulic head difference.

when the liquid is not pressurized and supplied to the liquid ejecting unit 12 by the hydraulic head difference, the liquid supply source 18 may be disposed so that the position of the hydraulic head of the liquid supply source 18 is lower than the position of the nozzles 43 in the perpendicular direction. Even in this case, when the on-off valve 20 enters the opened state, the liquid is supplied from the liquid supply source 18 to the liquid storage chamber 27B via the injection flow path 17, the liquid containing unit 21B, and the supply flow path 28.

The liquid containing unit 21B preferably includes a flexible portion 33B that is bent and displaced to change the capacity of the liquid containing unit 21B. The one-way valve 34 is installed in the supply flow path 28 forming the liquid flow path 22B. The return flow path 29 according to the embodiment includes no branch flow paths and the liquid storage chamber 27B forming the liquid flow path 22B includes one inlet 25 and one outlet 26.

In the liquid storage chamber 27B, the inlet 25 is preferably disposed on an end side of the liquid storage chamber 27B in the longitudinal direction and the outlet 26 is disposed on the other end side in the same longitudinal direction. In the perpendicular direction, the inlet 25 is preferably installed in the vicinity of the bottom portion of the liquid storage chamber 27B and the outlet 26 is preferably installed on an upper portion of the liquid storage chamber 27B. This is because it is easy to flow the liquid in the longitudinal direction and the perpendicular direction of the liquid storage chamber 27B and flow bubbles mixed in the liquid storage chamber 27B from the outlet 26.

The flowing mechanism 23B is, for example, a pump that flows the liquid in a supply direction (a direction indicated by an arrow of a solid line in FIG. 3) oriented from the liquid containing unit 21B to the liquid storage chamber 27B by performing first driving (forward rotation driving) and flows the liquid is a return direction (a direction indicated by an arrow of a two-dot chain line in FIG. 3) oriented from the liquid storage chamber 27B to the liquid containing unit 21B by performing second driving (backward rotation driving). The flowing mechanism 23B functions as a regulation portion by regulating the flow of the liquid in the return direction which is an opposite direction to the supply direction at the time of the first driving. The flowing mechanism 23B regulates the flow of the liquid in the supply direction at the time of the second driving. When the flowing mechanism 23B stops the driving, the flow of the return flow path 29 is not regulated.

Next, an operation of the liquid ejecting apparatus 11B according to the embodiment will be described.

The control unit 14 controls the flowing mechanism 23B according to a circumstance such that a circulation mode in which the liquid is circulated between the liquid containing unit 21B and the liquid flow path 22B, a supply mode in which the liquid is supplied from the liquid storage chamber 27B to the common liquid chamber 41, and a discharge mode in which the liquid is discharged from the nozzles 43 are set. For example, the control unit 14 sets the supply mode when printing is performed on a medium S and sets the circulation mode or the discharge mode when no printing is performed.

In the circulation mode, the flowing mechanism 23B circulates the liquid of the liquid storage chamber 27B in the return direction toward the liquid containing unit 21B via the return flow path 29 by performing second driving. Then, the liquid in the liquid containing unit 21B corresponding to an amount of liquid flowing to the liquid containing unit 21B flows toward the liquid storage chamber 27B via the supply flow path 28. In the flow of the liquid circulated in this way, foreign matters such as bubbles mixed in the liquid flow path 22B are collected in the liquid containing unit 21B.

In the supply mode, when the flow of the return flow path 29 is not regulated by stopping the driving of the flowing mechanism 23B, the liquid contained in the liquid containing unit 21B is allowed to flow to the liquid storage chamber 27B via the supply flow path 28 and the return flow path 29. That is, when the liquid is ejected from the nozzles 43, the liquid flows in the supply direction indicated by the arrow of the solid line in FIG. 3 in the return flow path 29 and the liquid flows in the direction indicated by the arrow of the solid line in FIG. 3 in the supply flow path 28, so that the liquid is supplied to the liquid storage chamber 27B. Therefore, when the liquid is ejected from the nozzles 43 and the liquid in the pressure chambers 42 and the common liquid chamber 41 decreases, the liquid is supplied swiftly from the liquid storage chamber 27B to the common liquid chamber 41.

Figure 4:
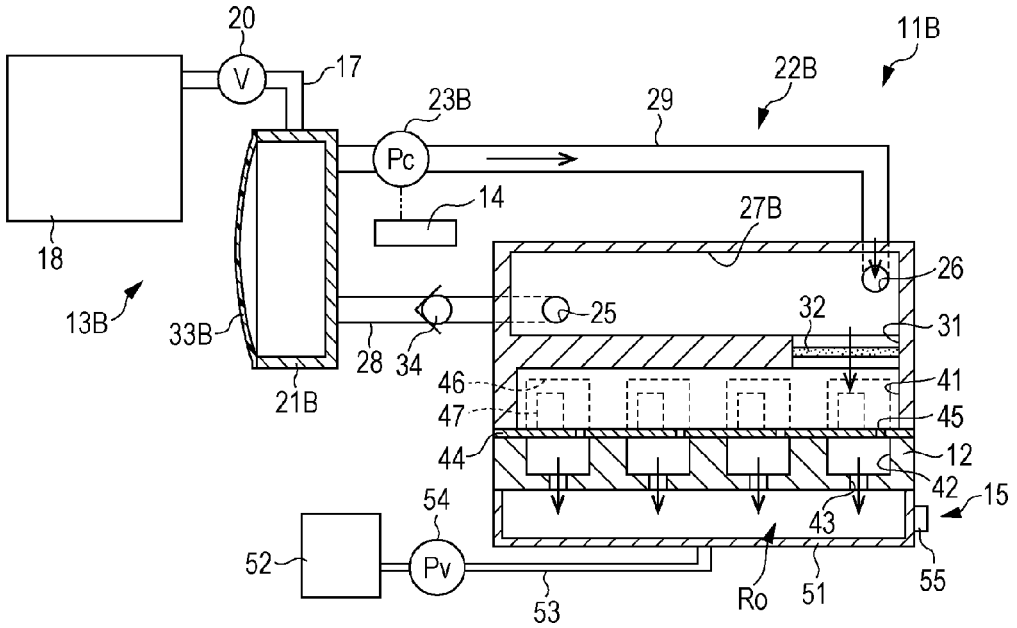
FIG. 4 is a schematic diagram when a liquid is discharged from nozzles of the liquid ejecting apparatus according to the second embodiment.

As illustrated in FIG. 4, in the discharge mode, when the flowing mechanism 23B performs the first driving, the flow of the return flow path 29 in the return direction is regulated and the liquid flows from the liquid containing unit 21B to the liquid storage chamber 27B. At this time, in the supply flow path 28, the flow of the liquid oriented from the liquid storage chamber 27B to the liquid containing unit 21B is regulated by the one-way valve 34. Therefore, the liquid flowing from the return flow path 29 to the liquid storage chamber 27B is discharged from the nozzles 43 via the filter chamber 31, the common liquid chamber 41, and the pressure chambers 42.

Next, effects of the liquid ejecting apparatus 11B according to the embodiment will be described.

In the supply mode set when the liquid is ejected from the nozzles 43, the liquid is supplied to the liquid storage chamber 27B via both of the supply flow path 28 and the return flow path 29. Therefore, an amount of liquid supplied to the liquid ejecting unit 12 increases compared to the case in which the liquid is supplied to the liquid storage chamber 27B via only the supply flow path 28. Therefore, even when an amount of liquid ejected per unit time from the liquid ejecting unit 12 increases, supply shortage of the liquid rarely occurs.

In the circulation mode, a change in pressure inside the liquid flow path 22B occurs by the driving of the flowing mechanism 23B in some cases. However, the change in the pressure is prevented when the flexible portion 33B of the liquid containing unit 21B is bent and displaced. By preventing the change in the pressure inside the liquid flow path 22B, meniscuses of the nozzles 43 are presented from being broken due to an increase in liquid pressure in the liquid ejecting unit 12 and the liquid is prevented from leaking from the nozzles 43.

When the liquid containing unit 21B or the liquid flow path 22B communicates with the atmosphere, the air is easily resolved in the liquid. When an amount of air dissolved in the liquid is large, the dissolved air turns to bubbles in some cases, for example, in a case in which the maintenance mechanism 15 performs suction cleaning and negative pressure acts on the liquid. Therefore, by realizing the configuration in which the liquid containing unit 21B does not communicate with the atmosphere as in the embodiment, it is possible to prevent the bubbles from occurring.

According to the second embodiment, it is possible to obtain the same advantages as those of the foregoing (1) to (4).

Third Embodiment

Next, a third embodiment of the invention will be described with reference to FIGS. 5, 6, and 7.

In the third embodiment, since constituent elements to which the same reference numerals as those of the first embodiment are given have the same configurations as those of the first embodiment, the description thereof will be omitted. Hereinafter, difference points from the first embodiment will be described mainly.

Figure 5:
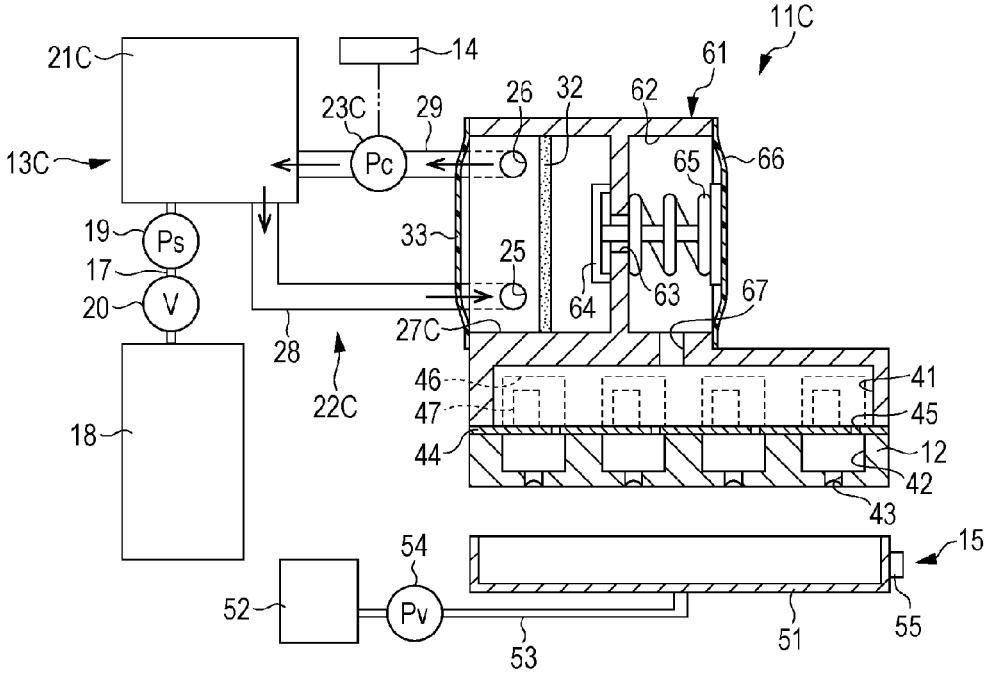
FIG. 5 is a schematic diagram illustrating the configuration of a liquid ejecting apparatus according to a third embodiment.

As illustrated in FIG. 5, a liquid supply mechanism 13C included in a liquid ejecting apparatus 11C according to the embodiment includes a liquid containing unit 21C which contains a liquid, a liquid flow path 22C which connects the liquid containing unit 21C to the liquid ejecting unit 12, and a flowing mechanism 23C in which the return flow path 29 forming the liquid flow path 22C is installed. The configurations of the liquid ejecting unit 12 and the maintenance mechanism 15 and the configuration in which the liquid is supplied from the liquid supply source 18 to the liquid containing unit 21C via the injection flow path 17 in which the on-off valve 20 and the pump 19 are installed are the same as those of the first embodiment.

The flowing mechanism 23C is, for example, a pump that flows the liquid in a return direction (a direction indicated by an arrow in FIG. 5) from a liquid storage chamber 27C to the liquid containing unit 21C. When the flowing mechanism 23C is configured as a pump, the flowing mechanism 23C may be a diaphragm pump or a gear pump as in the first embodiment or may be a tube pump that flows the liquid by pressing a tube forming the return flow path 29 in the return direction. When the driving of the flowing mechanism 23C is stopped, the flow of the return flow path 29 is assumed not to be regulated.

The filter 32 is installed in the liquid storage chamber 27C, and an upstream side which is the side of the liquid containing unit 21C and a downstream side which is the side of the liquid ejecting unit 12 are partitioned by the filter 32. In the liquid storage chamber 27C, the inlet 25 and the outlet 26 are disposed on the upstream side of the filter 32. The liquid storage chamber 27C includes a flexible portion 33 on the upstream side of the filter 32.

In the liquid storage chamber 27C, the outlet 26 is preferably disposed on the upper side in the perpendicular direction than at least the inlet 25. For example, the outlet 26 may be formed on the ceiling surface of the liquid storage chamber 27C. This is because bubbles flowing from the inlet 25 easily flow out from the liquid storage chamber 27C via the outlet 26. The inlet 25 may be formed on the bottom surface of the liquid storage chamber 27C. This is because the liquid stored in the liquid storage chamber 27C can be stirred by the liquid flowing from the inlet 25.

A pressure adjustment mechanism 61 including a valve chamber 62 is disposed between the liquid storage chamber 27C and the common liquid chamber 41. The valve chamber 62 communicates with a portion on the downstream side of the filter 32 of the liquid storage chamber 27C via an insertion hole 63 and communicates with the common liquid chamber 41 via a communication hole 67. A part of the wall surface of the valve chamber 62 is formed of a film 66 with flexibility.

The pressure adjustment mechanism 61 includes a valve body 64 which can block the insertion hole 63 and an urging member 65 which is accommodated inside the valve chamber 62 and urges the valve body 64. The urging member 65 is, for example, a spring and urges the valve body 64 from a valve opening position (a position illustrated in FIGS. 6 and 7) at which the insertion hole 63 is opened and a valve closing position (a position illustrated in FIG. 5) in which the insertion hole 63 can be blocked. When the film 66 is displaced in a direction in which the capacity of the valve chamber 62 decreases, the valve body 64 is pressurized to the displaced film 66 and is moved against an urging force of the urging member 65 from the valve closing position to the valve opening position. Then, when the valve body 64 is moved from the valve closing position to the valve opening position, the liquid storage chamber 27C and the valve chamber 62 communicate with each other.

Next, an operation of the liquid ejecting apparatus 11C according to the embodiment will be described.

The control unit 14 controls the flowing mechanism 23C according to a circumstance such that a circulation mode in which the liquid is circulated between the liquid containing unit 21C and the liquid flow path 22C and a supply mode in which the liquid is supplied from the liquid storage chamber 27C to the common liquid chamber 41 are set. For example, the control unit 14 sets the supply mode when the liquid is ejected from the nozzles 43 to a medium S and sets the circulation mode when no liquid is ejected to the medium S.

In the circulation mode, as illustrated in FIG. 5, the flowing mechanism 23C is driven to flow the liquid of the liquid storage chamber 27C in the return direction toward the liquid containing unit 21C via the return flow path 29. Then, the liquid in the liquid containing unit 21C corresponding to an amount of liquid flowing to the liquid containing unit 21C flows toward the liquid storage chamber 27C via the supply flow path 28. In the flow of the liquid circulated in this way, foreign matters such as bubbles mixed in the liquid flow path 22C are collected in the liquid containing unit 21C.

The flowing mechanism 23C may change the flowing direction of the liquid when first driving (forward rotation driving) is performed and when second driving (backward rotation driving) is performed. In this case, by changing the driving direction of the flowing mechanism 23C, the flowing direction of the liquid can be reversed in the circulation mode. In this case, by performing the second driving of the flowing mechanism 23C in the supply mode, the liquid may be supplied from the liquid containing unit 21C to the liquid storage chamber 27C.

Figure 6:
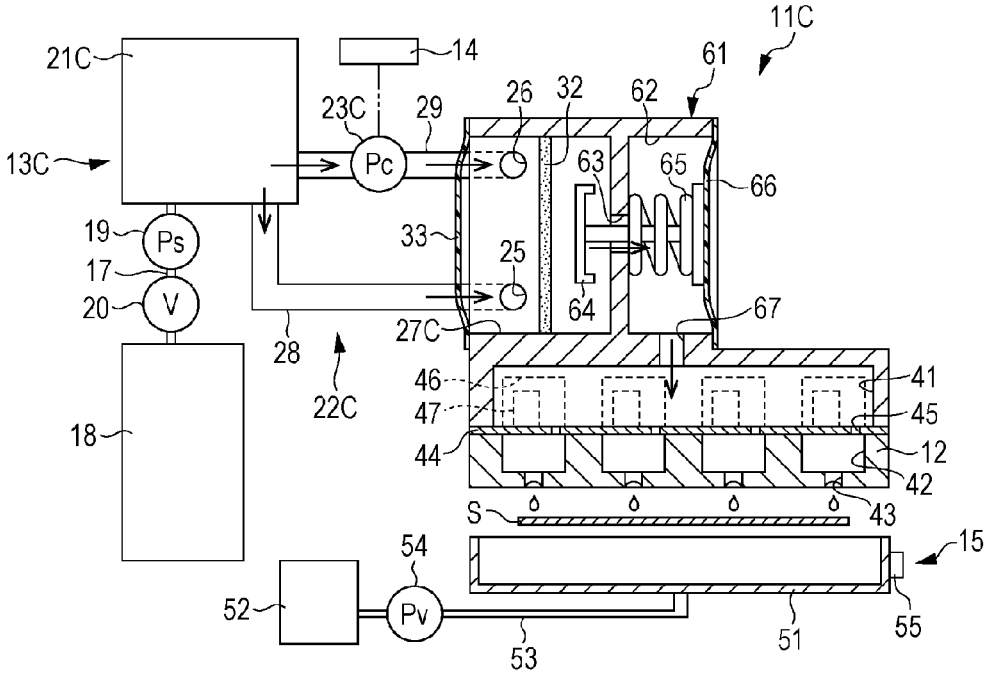
FIG. 6 is a schematic diagram when a liquid is discharged from nozzles of the liquid ejecting apparatus according to the third embodiment.

In the supply mode, as illustrated in FIG. 6, by stopping the driving of the flowing mechanism 23C, the liquid contained in the liquid containing unit 21C is allowed to flow to the liquid storage chamber 27C via both of the supply flow path 28 and the return flow path 29 when the flow of the return flow path 29 is not regulated.

At the time of printing in which the supply mode is set, when the liquid is ejected from the nozzles 43 by driving of the actuators 47, the liquid of the valve chamber 62 is supplied to the common liquid chamber 41 via the communication hole 67. When the liquid of the valve chamber 62 decreases, the film 66 is bent and displaced by a pressure difference between the liquid pressure in the valve chamber 62 and the atmospheric pressure in a direction in which the capacity of the valve chamber 62 decreases and pressurizes the valve body 64. When the bending force of the film 66 becomes greater than the urging force of the urging member 65, the valve body 64 is moved from the valve closing position to the valve opening position.

Here, the pump 19 is preferably configured as a pressurization pump that is driven at a predetermined timing so that the liquid storage chamber 27C is maintained at a given positive pressure or more, when the liquid is ejected from the nozzles 43. Thus, when the valve body 64 is moved to the valve opening position, the liquid in the liquid storage chamber 27C flows to the valve chamber 62 swiftly. In this case, the on-off valve 20 may be configured as a check valve that permits flow of the liquid oriented from the liquid supply source 18 to the liquid containing unit 21C and conversely regulates flow of the liquid oriented from the liquid containing unit 21C to the liquid supply source 18.

When the flowing mechanism 23C which can driven by the first driving and the second driving is adopted, the flowing mechanism 23C is driven by the second driving in the supply mode so that the liquid is supplied from the liquid containing unit 21C to the liquid storage chamber 27C.

When the pressure difference between the liquid pressure in the valve chamber 62 and the atmospheric pressure becomes a predetermined pressure by the flow of the liquid to the valve chamber 62, the valve body 64 is moved again to the valve closing position by the urging force of the urging member 65. Thus, the pressure adjustment mechanism 61 supplies the liquid to the common liquid chamber 41 according to an amount of consumed liquid by opening and closing the liquid flow path 22C based on the pressure difference between the liquid pressure and the atmospheric pressure.

At this time, the liquid flows in the supply direction indicated by the arrow in FIG. 6 in the return flow path 29 and the liquid flows in the direction indicated by the arrow in FIG. 6 in the supply flow path 28, so that the liquid is supplied to the liquid storage chamber 27C. That is, when printing is performed, the liquid is supplied swiftly from the liquid containing unit 21C to the liquid storage chamber 27C via both of the supply flow path 28 and the return flow path 29.

In the embodiment, foreign matters collected in the liquid containing unit 21C is discharged from the nozzles 43 by suction cleaning of the maintenance mechanism 15 rather than the discharge by the driving force of the flowing mechanism 23C. This is because the valve body 64 of the pressure adjustment mechanism 61 is moved from the valve closing position to the valve opening position when the pressure of the valve chamber 62 becomes a given negative pressure or more, but the valve body 64 is not moved to the valve opening position even when the valve body 64 enters a pressurization state in which the liquid pressure in the liquid storage chamber 27C is higher than the atmospheric pressure.

Figure 7:
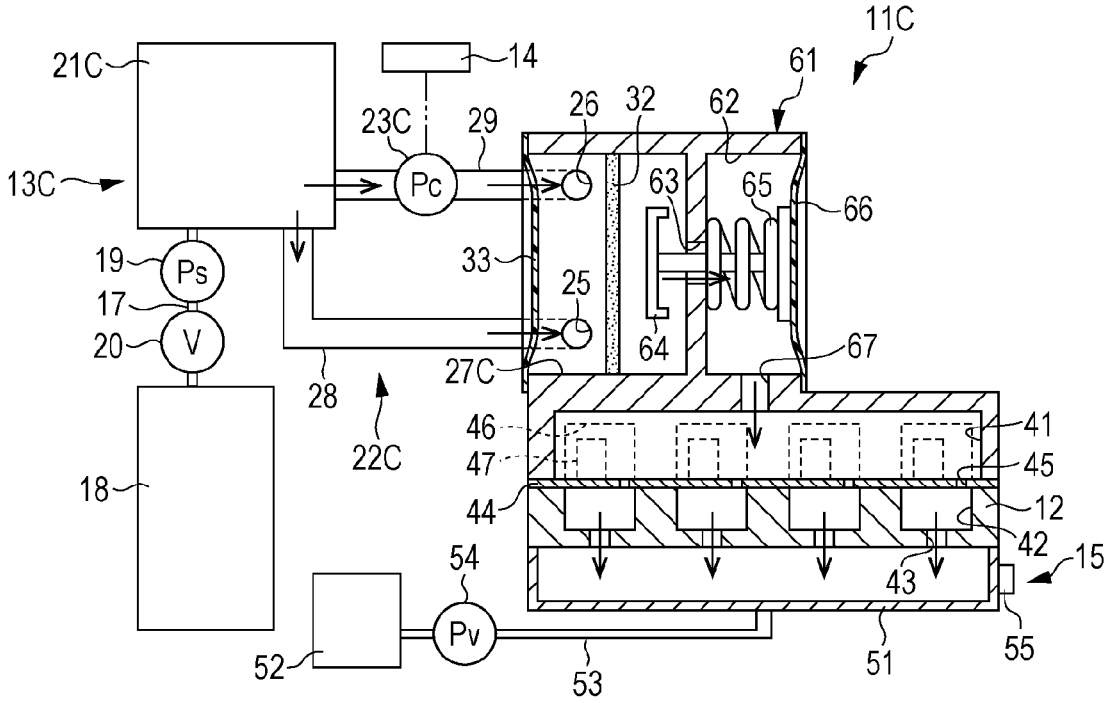
FIG. 7 is a schematic diagram when the liquid is discharged from the nozzles of the liquid ejecting apparatus according to the third embodiment.

As illustrated in FIG. 7, when the foreign matters collected in the liquid containing unit 21C are discharged, the cap 51 is disposed at the capping position and the driving of the flowing mechanism 23C is stopped. When the flow of the return flow path 29 is not regulated, the depressurization mechanism 54 is driven. Then, the negative pressure of the space Ro reaches the pressure of the valve chamber 62, the valve body 64 is moved against the urging force of the urging member 65 to the valve opening position. Thus, the liquid in the liquid containing unit 21C flows together with the foreign matters to the liquid storage chamber 27C via the return flow path 29 and the supply flow path 28 and is discharged from the nozzles 43 via the valve chamber 62 or the like from the liquid storage chamber 27C.

Next, effects of the liquid ejecting apparatus 11C according to the embodiment will be described.

In the supply mode set when the liquid is ejected from the nozzles 43, the liquid is supplied to the liquid storage chamber 27C via both of the supply flow path 28 and the return flow path 29. Therefore, an amount of liquid supplied to the liquid ejecting unit 12 increases compared to the case in which the liquid flows to the liquid storage chamber 27 via only the supply flow path 28. Therefore, even when an amount of liquid ejected per unit time from the liquid ejecting unit 12 increases, supply shortage of the liquid rarely occurs.

In the circulation mode, a change in pressure inside the liquid flow path 22C occurs by the driving of the flowing mechanism 23C in some cases. However, the change in the pressure is prevented when the flexible portion 33 of the liquid storage chamber 27C is bent and displaced. By preventing the change in the pressure inside the liquid flow path 22C, meniscuses of the nozzles 43 are presented from being broken due to an increase in liquid pressure in the liquid ejecting unit 12 and the liquid is prevented from leaking from the nozzles 43.

When the foreign matters collected in the liquid containing unit 21C are discharged, the liquid can be discharged via both of the supply flow path 28 and the return flow path 29 by stopping the driving of the flowing mechanism 23C and driving the depressurization mechanism 54 in the state in which the flow of the return flow path 29 is not regulated. Thus, the flow rate of the liquid flowing through the liquid flow path 22C can be configured to be fast to efficiently discharge the bubbles collected in the liquid containing unit 21C.

According to the third embodiment, it is possible to obtain the same advantages as those of the foregoing (1) to (4).

The foregoing embodiments may be modified as follows.

In the circulation mode, the liquid may be allowed to flow while discharging the liquid from the nozzles 43 by driving the flowing mechanism 23 so that the pressure acting on the meniscuses formed in the nozzles 43 is higher than the withstand pressure of the meniscuses by flow of the liquid. Even in this case, by disposing the cap 51 of the maintenance mechanism 15 at a position (containing position) facing the nozzles 43 of the liquid ejecting unit 12 or at the capping position at which the liquid ejecting unit 12 is capped, the liquid discharged from the nozzles 43 can be contained in the cap 51. Thus, the liquid coming from the nozzles 43 does not dirty a surrounding area.

An atmospheric communication port of the communication flow path which can communicate with the atmosphere may be installed in a region in which the space Ro of the liquid ejecting unit 12 is formed without installing the atmospheric opening valve 55 in the cap 51 of the maintenance mechanism 15. In this case, by installing an opening valve in the communication flow path, the space Ro can be opened to the atmosphere in a valve opening state of the opening valve and the space Ro can become substantially airtight in a valve closing state of the opening valve, when the liquid ejecting unit 12 is capped.

In the circulation mode, in order to prevent the meniscuses from being broken due to a change in the pressure in the nozzles 43 with the flow of the liquid in the liquid flow path 22, the space Ro formed by the capping may be pressurized or depressurized so that a pressure difference between the liquid side and the air side of the meniscuses is less than a meniscus withstand pressure. In this case, when a communication port communicating with the space Ro is installed in the cap 51 or the liquid ejecting unit 12, the depressurization may be performed by allowing the air to flow from the space Ro through the communication port or the pressurization may be performed by allowing the air to flow in the space Ro through the communication port. By driving the depressurization mechanism 54, the space Ro may be depressurized.

The liquid ejecting apparatus may be a printer that has only a printing function or may be a printer that is included in a facsimile, a copying apparatus, or a multi-function apparatus including a facsimile and a copying apparatus.

The liquid ejected by the liquid ejecting unit 12 may be a fluid (including a liquid, a liquid-like substance in which particles of a functional material are dispersed or mixed in a liquid, a fluid-like substance such as gel, and a solid flowing and ejected as a fluid) in addition to ink. For example, a liquid-like substance may be configured to be ejected which includes a form in which a material such as an electrode material or a color material (pixel material) used to manufacture a liquid crystal display, an electroluminescence (EL) display, a plane emission display is dispersed or resolved.

The entire disclosure of Japanese Patent Application No. 2014-000786, filed Jan. 7, 2014 is expressly incorporated by reference herein.

What is claimed is:

1. A liquid ejecting apparatus comprising:

a liquid containing unit that contains a liquid;

a liquid ejecting unit that ejects the liquid;

a liquid flow path that connects the liquid containing unit to the liquid ejecting unit; and a flowing mechanism that flows the liquid in the liquid flow path, wherein the liquid ejecting unit includes a plurality of nozzles, and a common liquid chamber which stores the liquid supplied from the liquid flow path, the common liquid chamber communicating with the nozzles, wherein the liquid flow path includes a liquid storage chamber which includes an inlet and an outlet and a wall formed with a flexible member and communicates with the common liquid chamber, a supply flow path which connects the liquid containing unit to the inlet, and a return flow path which connects the outlet to the liquid containing unit and in which the regulation portion is installed, wherein when the liquid is not ejected from the nozzles to a medium, the liquid is circulated between the liquid containing unit and the liquid flow path by driving of the flowing mechanism, and wherein when the liquid is ejected from the nozzles, the liquid contained in the liquid containing unit is allowed to flow to the liquid storage chamber via both of the supply flow path and the return flow path.

2. The liquid ejecting apparatus according to claim 1, wherein the liquid is circulated before the liquid is ejected from the nozzles to the medium.

3. The liquid ejecting apparatus according to claim 1, further comprising a cap configured to be moved relatively with respect to the liquid ejecting unit, wherein the cap is disposed at a position facing the nozzles of the liquid ejecting unit, when the liquid is circulated.

4. The liquid ejecting apparatus according to claim 1, further comprising a cap configured to be moved relatively with respect to the liquid ejecting unit, wherein the cap is disposed at a capping position at which the liquid ejecting unit is capped, when the liquid is circulated.

5. The liquid ejecting apparatus according to claim 4, wherein a space formed by the liquid ejecting unit being capped is depressurized, when the liquid is circulated.

6. The liquid ejecting apparatus according to claim 1, further comprising a regulation portion configured to regulate flow of the liquid in the liquid flow path, wherein when the liquid is not ejected from the nozzles to a medium and the regulation portion regulates flow of the return flow path, the liquid is discharged from the nozzles by driving of the flowing mechanism.

7. The liquid ejecting apparatus according to claim 1, wherein when the liquid is not ejected from the nozzles to a medium, the liquid is circulated between the liquid containing unit and the liquid flow path with the liquid being discharged from the nozzles by driving of the flowing mechanism so that a pressure acting on meniscuses formed in the nozzles is higher than a withstanding pressure of the meniscuses.

8. The liquid ejecting apparatus according to claim 1, wherein a filter is installed between the liquid storage chamber and the common liquid chamber.

9. The liquid ejecting apparatus according to claim 1, wherein a one-way valve permitting flow of the liquid from the liquid containing unit to the liquid storage chamber and regulating the flow of the liquid from the liquid storage chamber to the liquid containing unit is installed in the supply flow path.

10. The liquid ejecting apparatus according to claim 1, further comprising a pressure adjustment mechanism including a chamber disposed between the liquid storage chamber and the common liquid chamber, wherein the pressure adjustment mechanism includes a valve body opening and closing a communication path between the liquid storage chamber and the chamber based on a pressure difference between a pressure in the chamber and a pressure outside of the chamber.

11. The liquid ejecting apparatus according to claim 1, wherein the liquid storage chamber includes a plurality of the outlets, and wherein the return flow path includes a main flow path communicating with the liquid containing unit and a plurality of branch flow paths branched from the main flow path and communicating with the outlets.

12. The liquid ejecting apparatus according to claim 11, wherein in the liquid storage chamber, the plurality of outlets are disposed at positions closer to end portions of the liquid storage chamber in a longitudinal direction of the liquid storage chamber than the inlet, and the inlet is disposed between the outlets in the longitudinal direction.

* * * * *